United States Patent [19]

Nakayama et al.

[11] 4,381,178

[45] Apr. 26, 1983

[54] SWASH-PLATE TYPE COMPRESSOR

[75] Inventors: Shozo Nakayama; Kimio Kato, both of Kariya; Nobuyuki Araki, Nagoya; Kenji Takenaka, Kariya, all of Japan

[73] Assignee: Kabushiki Kaisha Toyoda Jidoshokki Seisakusho, Aichi, Japan

[21] Appl. No.: 171,045

[22] Filed: Jul. 22, 1980

[30] Foreign Application Priority Data

Aug. 6, 1979 [JP] Japan ..... 54-99995

[51] Int. Cl.[3] ..... F04B 1/16; F04B 1/18

[52] U.S. Cl. ..... 417/269

[58] Field of Search ..... 417/269

[56] References Cited

U.S. PATENT DOCUMENTS

| | | | |
|---|---|---|---|
| 3,215,341 | 11/1965 | Francis | 417/269 |
| 3,557,664 | 1/1971 | Nomura | 417/269 |
| 3,712,759 | 1/1973 | Olson, Jr. | 417/269 |
| 4,101,250 | 7/1978 | Nakayama | 417/269 |
| 4,135,862 | 1/1979 | Degawa | 417/269 |
| 4,229,145 | 10/1980 | Izizuka | 417/269 |
| 4,260,337 | 4/1981 | Nomura | 417/269 |
| 4,274,813 | 6/1981 | Kishi | 417/269 |
| 4,299,543 | 11/1981 | Shibuya | 417/269 |

FOREIGN PATENT DOCUMENTS

| | | | |
|---|---|---|---|
| 1058195 | 3/1954 | France | 417/269 |
| 1302653 | 7/1962 | France | 417/269 |
| 55-109782 | 8/1980 | Japan | 417/269 |

*Primary Examiner*—William L. Freeh

*Attorney, Agent, or Firm*—Browdy & Neimark

[57] ABSTRACT

A swash-plate type compressor wherein a plurality of pistons fitted into a plurality of cylinder bores having their center on a circle are reciprocated by a swash-plate secured to a rotary shaft at a tilt angle. A swash-plate chamber rotatably accommodating the swash-plate concurrently functions as a passage for the refrigerant gas sucked, and an annular refrigerant gas passage, whose external diameter is larger than that of a circum-circle of the aforementioned cylinder bores and whose inner side is open to the swash-plate chamber, is formed on the external side of the swash-plate chamber. This annular passage for the refrigerant gas sucked functions as a by-pass therefor, diminishes the flow resistance of the refrigerant gas, and facilitates the cooling of the pistons with a result of reducing the operation noise produced from the engaging portion of the pistons and the swash-plate.

8 Claims, 2 Drawing Figures

SWASH-PLATE TYPE COMPRESSOR

FIELD OF THE INVENTION

This invention relates to an improvement of a swash-plate type compressor, and more particularly to that type compressor wherein a refrigerant gas is compressed by a reciprocal movement, caused by a swash-plate secured to a rotary shaft, of a plurality of pistons fitted into a plurality of concyclically arranged cylinder bores.

BACKGROUND OF THE INVENTION

In the above-mentioned swash-plate type compressors a kind wherein a swash-plate chamber itself concurrently functions as a passage for the refrigerant gas is known. This kind of compressors have been, however, problematic in two respects, i.e., (1) unsmooth flowing of refrigerant gas due to a large resistance to the gas flow in the swash-plate chamber, and (2) frequent occurrence of noise in the operation time from engagement between the swash-plate and the piston.

The large resistance in the swash-plate chamber to the gas flow seems to be against normal intuitive thinking, but the refrigerant gas does not flow smoothly, in fact unexpectedly, because of a possible rotational movement of the gas around the swash-plate induced by the high speed rotation thereof.

The operation noise, whose cause was long unknown, has been made clear by a long study in the laboratory by the applicants, who found that it is attributable to a gradual increase of clearance between the engaging members on both sides, that is, the piston on one side and the swash-plate, shoe, etc. on the other side. Although the rotating members such as the swash-plate, shoe, ball, etc. are all cooled sufficiently and universally by the refrigerant gas, the piston, particularly the connecting portion thereof, which is reciprocated in one limited place and cooled only from its inside surface facing the swash-plate chamber by the refrigerant gas can not be fully cooled. Specifically, the pistons distantly located from the refrigerant gas inlet are apt not to be cooled enough.

It has been made clear, as a result of the study, that a certain thermal-expansion difference which takes place between the well cooled portion including the swash-plate, shoe, ball, etc., and the unsatisfactorily cooled portion of the piston causes an increase of the shoe clearance, leading to the noise production.

SUMMARY OF THE INVENTION

This invention was made from such a background. The present invention is therefore chiefly aimed at, in a swash-plate type compressor wherein the swash-plate chamber, provided with an exclusive refrigerant gas outlet in addition to a refrigerant gas inlet, constitutes a part of the refrigerant gas flow passage, diminishing the flow resistance of the refrigerant gas and at the same time preventing the noise production from the engaging portion between the swash-plate and the piston.

It is another object of this invention to provide a compressor capable of achieving the above-mentioned main objects, while being as simple in construction and as low in cost as possible.

Still another object of this invention is to provide a compressor wherein an annular passage for the sucked refrigerant gas, whose external diameter is larger than that of a common circumcircle of the plurality of cylinder bores and whose inner side is open to the swash-plate chamber, is formed on the external side of the swash-plate chamber.

In a compressor in accordance with this invention, an annular passage for the refrigerant gas formed on the external side of the pistons favorably functions in cooling a respective part of the pistons surrounding the recess for being engaged with a swash-plate from the external surface thereof, which contributes to maintaining the shoe clearance at a most suitable value with a result of diminishing the operation noise of the compressor. As the fairly large part of the refrigerant gas passes through this annular passage where the flow resistance is small, the sucking resistance of the refrigerant gas is reduced to enhance the operation efficiency of the compressor. Reduction of the whole weight of the compressor is one of the other merits of this invention.

DETAILED DESCRIPTION OF THE PREFERRED EMBODIMENT

With reference to the appended drawings an embodiment of a compressor applied to an air-conditioner for a car will be described in detail hereunder.

Figure 1:
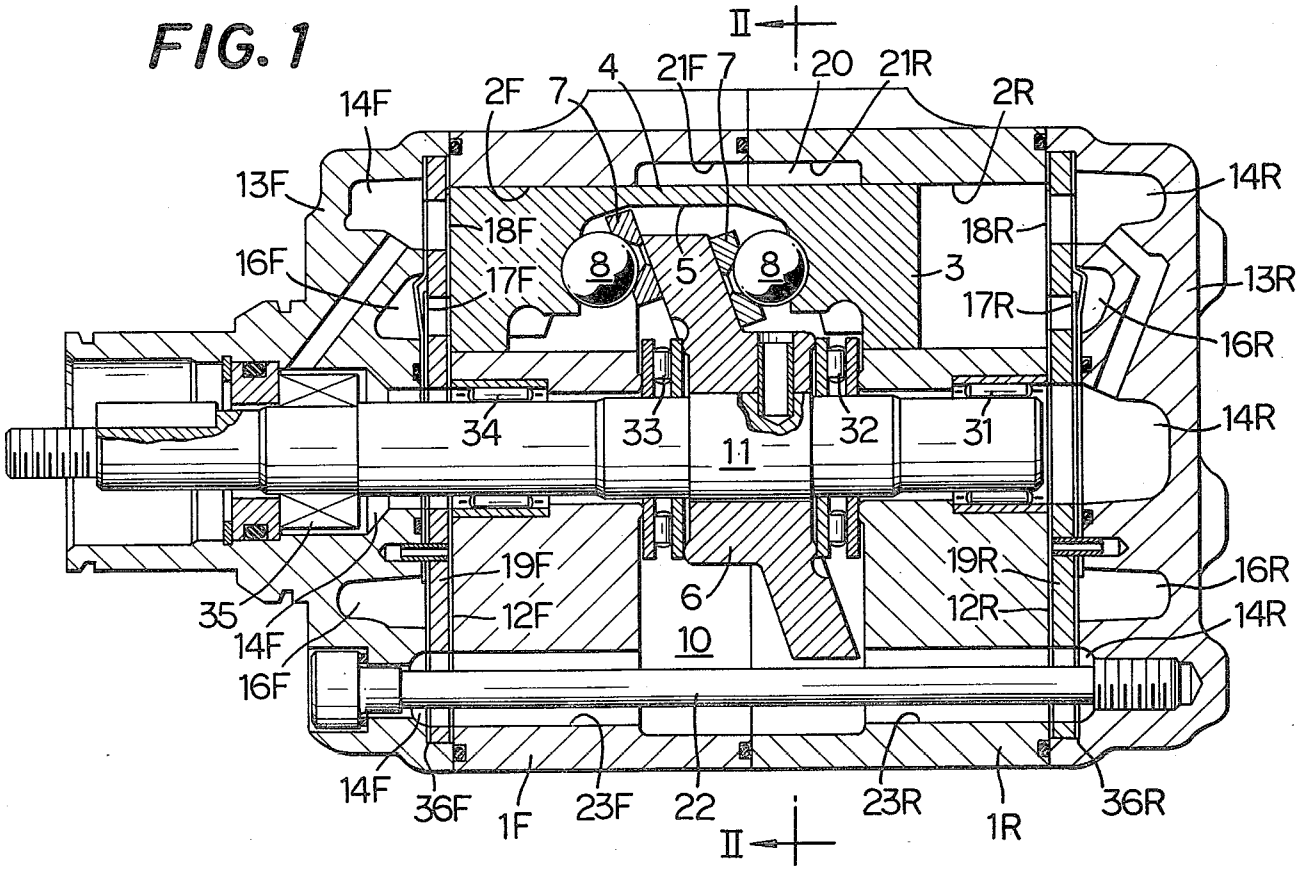
FIG. 1 is an axial sectional view of an embodiment of a compressor in accordance with this invention.
Figure 2:
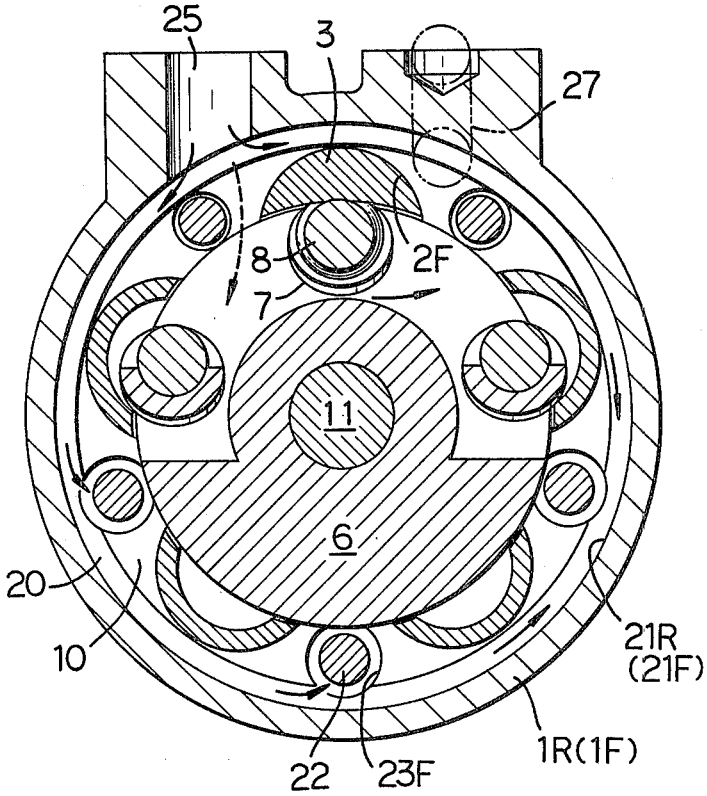
FIG. 2 is a cross sectional view taken along the section line II—II in FIG. 1.

In a pair of mutually symmetrically shaped cylinder blocks 1F (front) and 1R (rear) five cylinder bores 2F and 2R are formed on either side, as shown in FIGS. 1 and 2, for being slidably fitted respectively by a piston 3. The pistons 3 are of the two-head type having a head on both sides thereof which are connected by a connecting portion 4, and are respectively, at an engaging recess 5 confined by the both heads and the connecting portion 4, engaged with the peripheral portion of a swash-plate 6 by way of a shoe 7 and a ball 8. The swash-plate 6 is disposed in a swash-plate chamber 10 which is formed between both cylinder blocks 1F and 1R and secured to a rotary shaft 11, which is rotatably retained by the cylinder blocks 1F and 1R, via bearings 31, 32, 33, and 34, and a seal 35, with a certain tilt angle thereto. Rotation movement of the swash-plate 6 is converted to a reciprocation movement of the piston 3.

Either external end of the cylinder blocks 1F, 1R, as shown in FIG. 1, is covered by a respective housing 13F, 13R, sandwiching inbetween valve seats 12F, 12R, valve plates 19F, 19R and gaskets 36F, 36R. In each housing 13F, 13R suction chambers 14F, 14R and discharge chambers 16F, 16R are respectively formed. Between the suction chambers 14F, 14R and the cylinder bores 2F, 2R suction valves 18F, 18R are respectively disposed. On the other hand, between the cylinder bores 2F, 2R and the discharge chambers 16F, 16R discharge valves 17F, 17R are disposed.

On the external side of the swash-plate chamber 10 an annular refrigerant gas passage 20 having an identical width with the swash-plate chamber 10 and a depth (thickness) approx. 4 mm is formed, as an outwardly expanded part of the swash-plate chamber 10 in reality and positioned across the joining portion of both cylinder blocks 2F, 2R. This refrigerant gas passage 20 is substantially an integration of a pair of counter bores 21F, 21R, having a larger diameter than that of a common circumcircle to all of the cylinder bores 2F, 2R, and both counter bores are formed simultaneously with the swash-plate chamber 10, which means substantially an outward expansion of the swash-plate chamber 10 by the depth of the refrigerant gas passage 20.

The swash-plate chamber 10 and the refrigerant gas passage 20 are, by five bolt-piercing holes 23F, 23R for accommodating bolts 22 which connect both cylinder blocks 1F, 1R together, communicated with the suction chamber 14F, 14R. As can be seen in FIG. 2, the bolt-piercing holes 23F of the cylinder block 1F are all located respectively on a concentric circle in the vicinity of the border between the swash-plate chamber 10 and the refrigerant gas passage 20 and progressively enlarged in the diameter as the distance from a refrigerant sucking or inlet port 25, formed in the cylinder blocks 1F, 1R, becomes greater. The situation is just the same with the cylinder block 1R. The refrigerant gas sucking port 25 is opened, being located between two neighboring pistons out of the plural ones, at an inclined or tilted posture to a normal line of the common circumcircle of the cylinder bores 2F, 2R.

In a swash-plate type compressor of such a structure, lubricating oil sucked in a mist state together with the refrigerant gas through the refrigerant gas sucking port 25 goes straight downward because of its large mass, as illustrated in FIG. 2 with an arrow of medium broken line to hit the rotating swash-plate, shoes 7, balls 8, etc. for lubricating the sliding surfaces among these parts.

On the other hand, the refrigerant gas which is sucked with the lubricating oil is flowed, because of its small mass, in clockwise and counterclockwise directions shown with arrows of solid lines in the drawing passing through the refrigerant gas passage 20 and the swash-plate chamber 10 to cool the piston connecting portions 4, shoes 7, balls 8, etc. The refrigerant gas is mainly flowed into the suction chamber 14F (or 14R) through the bolt-piercing holes 23F (23R) distantly located from the refrigerant sucking port 25.

In this instance, the swash-plate chamber 10 does not allow the smooth flowing through of the sucked refrigerant gas because of the high speed rotation of the swash-plate irrespective of the large space thereof, which facilitates a good flowing of the refrigerant gas through the refrigerant gas passage 20 annularly formed as a by-pas on the external side of the swash-plate chamber 10, with a result of cooling the piston connecting portion 4 from both sides, i.e., outside and inside. This is greatly helpful in maintaining the piston connecting portion 4 at an almost similarly cooled state with the swash-plate 6, the shoes 7, and the balls 8. The shoe clearance can be consequently maintained at a most suitable value, which prevents the noise production caused by the collision or hitting among the swash-plate 6, the shoes 7, the balls 8, and the pistons 3, which takes place at each direction-change of load on these members in response to the reciprocation of the pistons 3.

Another merit lies in that the sucking amount of the refrigerant gas per unit of time is remarkably increased, because a fairly large portion of the refrigerant gas can flow through the refrigerant gas passage 20 where the flow resistance is very small, which diminishes the sucking resistance of the refrigerant gas as a whole.

Still another feature to be noted is that the bolt-piercing holes 23F, 23R are simultaneously utilized as a refrigerant gas passage or communicating route, which enables disposition of as many as five of the pistons 3, and that the bolt-piercing holes 23F, 23R are made larger in the diameter where the distance from the refrigerant gas sucking port 25 is greater, which facilitates the refrigerant gas flowing even to the lowest positioned pistons 3 in a similar way for cooling them equally. This avoids the conventional disadvantage of leaving the lowest positioned pistons in a poorly cooled state. Incidentally, the refrigerant gas passage communicating the swash-plate chamber 10 and the suction chamber may be an exclusive one instead of the bolt-piercing hole, and the number thereof may be freely chosen.

Another important comment is that the width of the refrigerant gas passage may be wider or narrower than that of the swash-plate chamber. The depth of the refrigerant gas passage is preferred to be greater than 2 mm, more preferred to be greater than 3 mm. The depth as shallow as 1 mm is short of expectation in respect of the effect of the invention because of insufficient flow of the refrigerant gas therethrough.

It goes without saying that this invention may be varied and modified within the spirit of the invention by those skilled in the art.

What is claimed is:

1. A swash-plate type compressor comprising:

a rotary shaft;

a swash-plate secured to said rotary shaft;

a cylinder block rotatably supporting said rotary shaft, and consisting of two halves each having a plurality of circumferentially spaced cylinder bores which extend axially of said rotary shaft and have the centers on a circle whose center is located on the axis of said rotary shaft, said two halves being assembled in abutment with each other such that said cylinder bores in said respective two halves are in alignment with each other, said cylinder block having a swash-plate chamber rotatably accommodating said swash-plate and constituting a passage for sucked refrigerant gas; and a plurality of pistons slidably received in said cylinder bores and each having an engaging recess engaging said swash-plate, said cylinder block further having an inlet passage through which a stream of refrigerant gas is sucked therein, a continuously annular passage communicated with said inlet passage, concentric with said circle and open to said swash-plate chamber, said annular passage being formed circumferentially in a radially inward portion of the cylindrical wall of said cylinder block, having a diameter larger than that of a common circumcircle of said cylinder bores, and functioning as a by-pass for said sucked refrigerant gas flowing through said swash-plate chamber, and a plurality of circumferentially spaced, axially extending, holes communicated with said swash-plate chamber, said annular passage and said cylinder bores, and accommodating fixing bolts for clamping said two halves, said holes having a diameter larger than that of said fixing bolts so that an annular space formed between the inner surface of said holes and the outer surface of said bolts serves as a communicating passage to said cylinder bores, said diameter of said holes increasing with an angular distance of said holes as measured from a junction of said inlet passage and said annular passage, whereby the sucked refrigerant gas is evenly delivered to said plurality of pistons and a portion of each of said pistons adjacent to said engaging recess is cooled evenly on both radially inward and outward sides thereof.

2. A compressor as claimed in claim 1, wherein said inlet passage is open to said annular passage at a position between two neighboring pistons of said plurality of pistons, and tilted to a normal line of said circumcircle.

3. A compressor as claimed in claim 1, wherein said engaging recess of said pistons engages said swash-plate by way of a pair of shoes which slide on opposite surfaces of said swash-plate and a pair of balls which are sandwiched by said shoes and said piston.

4. A compressor as claimed in claim 1, wherein the external diameter of said annular passage is larger by not less than 4 mm than the diameter of said circumcircle.

5. A compressor as claimed in claim 1, wherein the external diameter of said annular passge is larger by not less than 6 mm than the diameter of said circumcircle.

6. A compressor as claimed in claim 1, wherein said annular passage is an extension of said swash-plate chamber radially outwardly of said circumcircle.

7. A compressor as claimed in claim 1, wherein said annular passage and said swash-plate chamber are constituted by a combination of two counter bores formed circumferentially in abutting end portions of said respective two halves such that the diameter thereof is larger than that of said circumcircle.

8. A compressor as claimed in claim 5, wherein each of said pistons comprises two heads and a connecting portion connecting said two heads, said two heads and said connecting portion defining said engaging recess, and said connecting portion axially extends across a space consisting of said annular passage and said swash-plate chamber.

* * * * *